US011197598B2

(12) United States Patent
Miller

(10) Patent No.: US 11,197,598 B2
(45) Date of Patent: Dec. 14, 2021

(54) HANDLE-STORABLE SPONGE MOP WITH SCRUBBER

(71) Applicant: Tracy E. Miller, Fort Plain, NY (US)

(72) Inventor: Tracy E. Miller, Fort Plain, NY (US)

( * ) Notice: Subject to any disclaimer, the term of this patent is extended or adjusted under 35 U.S.C. 154(b) by 0 days.

(21) Appl. No.: 16/925,269

(22) Filed: Jul. 9, 2020

(65) Prior Publication Data

US 2020/0337514 A1 Oct. 29, 2020

Related U.S. Application Data

(63) Continuation-in-part of application No. 16/265,268, filed on Feb. 1, 2019, now Pat. No. 10,743,736.
(Continued)

(51) Int. Cl.
*A47L 13/12* (2006.01)
*A47L 13/16* (2006.01)
(Continued)

(52) U.S. Cl.
CPC ..... *A47L 13/12* (2013.01); *A47L 13/16* (2013.01); *A47L 13/257* (2013.01); *A47L 13/46* (2013.01)

(58) Field of Classification Search
CPC ..... A47L 13/00; A47L 13/10; A47L 13/12; A47L 13/16; A47L 13/20; A47L 13/24;
(Continued)

(56) References Cited

U.S. PATENT DOCUMENTS 1,360,926 A 11/1920 Glenn
1,476,396 A 2/1923 Dickson
(Continued)

FOREIGN PATENT DOCUMENTS

CA 2314126 A1 1/2001
CN 201098090 Y 8/2008
(Continued)

OTHER PUBLICATIONS

Website: https://www.amazon.com/Masthome-Household-Double-side-Microfiber-Cleaning/dp/B07C2LZRGC/ref=sr_1_1_sspa?ie=UTF8&qid=1539661428&sr=8-1-spons&keywords=broom+mop&psc=1 Downloaded Oct. 13, 2018 Masthome Household Printed Double-side Mop, Microfiber Heating Duster, Broom 6 PCS Cleaning Set for Household Cleaning.
(Continued)

*Primary Examiner* — Mark Spisich
(74) *Attorney, Agent, or Firm* — Russ Weinzimmer & Associates, P.C.

(57) ABSTRACT

A handle-storable sponge mop with scrubber for use at a handle end of a broom handle. The sponge mop includes a sponge body, a scrubber pad, and a sponge head. The sponge body includes a working channel extending longitudinally through the sponge body, and a storage channel extending across through the sponge body, each channel configured to receive the handle end of a broom handle. The sponge mop also includes a scrubber pad shaped to match both the cross-sectional shape of the sponge body and the sponge head. The scrubber pad is attached to the sponge body, and the sponge head is attached to the scrubber pad. The handle-storage sponge mop can be used to convert a broom to a mop. The edge of the scrubber pad can be used as needed. The sponge mop stores conveniently along a broom handle so that it's always readily available for use.

22 Claims, 7 Drawing Sheets

Related U.S. Application Data

(60) Provisional application No. 62/879,243, filed on Jul. 26, 2019.

(51) Int. Cl.
*A47L 13/257* (2006.01)
*A47L 13/46* (2006.01)

(58) Field of Classification Search
CPC ..... A47L 13/257; A47L 13/42; A47L 13/46; A47L 13/48; A46B 15/0055; A46B 17/00; A46B 17/08; A46B 2200/30; A46B 2200/302
USPC ..... 15/114, 116, 244.1, 244.4; D4/116, 119; D32/40, 42, 50, 51, 52
See application file for complete search history.

(56) References Cited

U.S. PATENT DOCUMENTS

| | | | |
|---|---|---|---|
| 1,838,448 | A | 12/1931 | Pomfret |
| 2,446,814 | A | 8/1948 | Crofton |
| 2,555,858 | A | 6/1951 | Oleksy |
| 2,686,329 | A | 8/1954 | King |
| 2,691,788 | A | 1/1960 | Thomasson |
| 2,919,455 | A | 1/1960 | Turner |
| 3,054,127 | A | 9/1962 | Petsch et al. |
| 3,058,139 | A | 10/1962 | Dryden |
| 3,274,635 | A | 9/1966 | Myers |
| 3,570,038 | A | 3/1971 | Jones |
| 3,753,267 | A | 8/1973 | Johnson, Sr. |
| 4,285,096 | A | 8/1981 | Swaim |
| 5,351,356 | A | 10/1994 | Townsend, Jr. |
| 5,799,357 | A | 9/1998 | Taylor |
| 5,903,948 | A | 5/1999 | Williams et al. |
| 6,543,081 | B1 | 4/2003 | Cohen |
| 6,701,567 | B2 | 3/2004 | Smith |
| 6,735,809 | B2 | 5/2004 | Parks |
| 6,745,434 | B2 | 6/2004 | Smith et al. |
| 9,554,685 | B2 | 1/2017 | Gadsden |
| 2014/0047655 | A1 | 2/2014 | Clayton et al. |
| 2018/0338664 | A1* | 11/2018 | Park ..... B24D 15/04 |

FOREIGN PATENT DOCUMENTS

| | | | |
|---|---|---|---|
| CN | 201320134 | Y | 10/2009 |
| CN | 201356515 | Y | 12/2009 |
| CN | 202942047 | U | 11/2012 |
| CN | 103082957 | A | 5/2013 |
| CN | 203789857 | U | 12/2013 |
| CN | 204158327 | U | 10/2014 |
| EP | 1419726 | B1 | 5/2004 |
| GB | 2255900 | A | 5/1991 |
| JP | 2005312494 | A | 11/2005 |

OTHER PUBLICATIONS

Website: https://www.wholesalejanitorialsupply.com/lysol-brand-lysol-sponge-mop-9-48-steel-handle/ Downloaded Oct. 13, 2018 Lysol Sponge Mop "Steel Handle".

Website: http://www.super-cool-products.com/broomandmicrofibermop.html Downloaded Oct. 13, 2018 The Super® Rubber Broom and Microfiber Mop One Steel Telescopic Handle and Screw-On Rubber Broom and Microfiber Mop.

Website: https://www.youbeli.com/korean-double-sided-mop-26amp3b-broom-p-1680704.html Downloaded Oct. 13, 2018 Korean Double-Sided Mop & Broom.

Website: https://www.filenesbasement.com/product/housekeeping-laundry/415382-3496/bulk-buys-dual-head-auto-brush-case-of-24.html Downloaded Oct. 13, 2018 Dual Head Auto Brush.

* cited by examiner

HANDLE-STORABLE SPONGE MOP WITH SCRUBBER

CROSS-REFERENCE TO RELATED APPLICATIONS

The present application claims priority from Provisional Patent Application No. 62/879,243 filed Jul. 26, 2019, titled "A HANDLE-STORABLE SPONGE MOP WITH SCRUBBER", which is hereby incorporated by reference in its entirety, and is a Continuation-in-Part of U.S. patent application Ser. No. 16/265,268 filed Feb. 1, 2019, titled "A HANDLE-STORABLE SPONGE MOP", now U.S. Pat. No. 10,743,736, which is hereby incorporated by reference in its entirety.

FIELD OF THE INVENTION

This invention relates generally to mops, and more particularly to sponge mops.

BACKGROUND OF THE INVENTION

There is a need for an easier way to clean kitchen and bathroom edges and corners after using a broom, a regular mop, or a steamer mop to clean a floor surface. The dirt left by any mop, i.e., steamer mops, flat mops, string mops, or mopping systems with pad refills, is too much to just leave on the floor. Consequently, it is often necessary to carefully bend over, or get on hands and knees with a wet paper towel, to wipe the dirt by hand that got pushed into the corners after using any of a variety of mops for floor cleaning.

Also, when using a typical mop, it is problematic when one needs to place the mop to allow it to dry. If the mop is stored upside down to prevent the wet mop from touching the floor, the mop is likely to fall over. If the wet mop is allowed to rest on the floor while it dries, an unsanitary condition is created where the damp mop can damage the floor and/or promote bacterial growth and mold.

SUMMARY OF THE INVENTION

The sponge mop of the invention provides an easier way to clean kitchen and bathroom edges and corners after using a broom, a regular mop, or a steamer mop to clean a floor surface. By using the sponge mop of the invention at the end of a broom handle, it is no longer necessary to carefully bend over, or get on hands and knees with a wet paper towel, to wipe the dirt by hand that got pushed into the corners after using any of a variety of mops for floor cleaning.

Also, when one needs to allow the sponge mop to dry, it can be placed along the handle of a broom, rather than a standard wet mop being stored upside down to prevent the wet mop from touching the floor, which could result in the mop falling over. Placing the sponge mop of the invention along the handle of the broom also avoids allowing the sponge mop to rest on the floor while it dries, which would create an unsanitary condition where a damp standard mop would damage the floor and/or promote bacterial growth and mold.

A general aspect of the invention is a handle-storable sponge mop with scrubber for use at a handle end of a broom handle. The handle-storable sponge mop includes: a sponge body having: a trailing surface, a leading surface, and a body surface extending between the trailing surface and the leading surface, a working channel extending longitudinally through the sponge body, the working channel having a first open end in the trailing surface, and a second open end in the leading surface, and a storage channel extending across through the sponge body, the storage channel having two open ends in the body surface, the working channel and the storage channel each configured to receive the handle end of a broom handle; a scrubber pad shaped so as to match the leading surface of the sponge body, the scrubber pad being attached to the leading surface of the sponge body; and a sponge head having a base surface and a sponge head surface, the base surface shaped so as to match the shape of the leading surface of the sponge body, the base surface of the sponge head being attached to the scrubber pad.

In some embodiments, the sponge head is shaped as a truncated prism, the truncated prism having a base surface, a leading face, a longest rectangular side, a shortest rectangular side, and a pair of right-trapezoidal sides, the leading face and the longest rectangular side together forming a leading beveled cleaning edge.

In other embodiments, the storage channel extends between the pair of right-trapezoidal sides.

In other embodiments, the open channel extends perpendicularly between the pair of right-trapezoidal sides of the truncated prism.

In other embodiments, the truncated prism is one of: a triangular truncated prism, a square truncated prism, a rectangular truncated prism, a hexagonal truncated prism, an octagonal truncated prism.

In other embodiments the base surface is one of: a triangle, a square, a rectangle, a hexagon, an octagon, a circle.

In other embodiments, the truncated prism is a truncated right prism in which the longest rectangular side, the shortest rectangular side, and the pair of right-trapezoidal sides are perpendicular to the base surface.

In some embodiments, the working channel extends perpendicularly into the base face of the sponge body.

In some embodiments, the working channel and the storage channel are cylindrical channels.

In some embodiments, the working channel and the storage channel intersect.

In some embodiments, a central axis of the working channel and a central axis of the storage channel are in substantially perpendicular relationship.

In some embodiments, a central axis of the storage channel intersects with a central axis of the working channel.

In some embodiments, a central axis of the storage channel extends perpendicularly with respect to a central axis of the sponge body.

In some embodiments, the sponge mop body and the sponge mop head are made entirely of absorbent material. In further embodiments, the absorbent material is selected from: polyurethane foam, foam rubber sponge material, microfiber textile, stranded cotton, stranded synthetic fiber, and stranded Rayon.

In some embodiments, the scrubber pad is made from heavy duty fiber material. In further embodiments, the scrubber pad is ¼" thick.

In some embodiments, the scrubber pad is configured to as to resist penetration by the handle end of a broom handle when the broom handle is forced against the scrubber pad during use.

In some embodiments, the sponge head is shaped so as to include at least a quarter cylinder.

In some embodiments, the sponge head is shaped so as to include at least a pyramid.

In some embodiments, the sponge head is shaped as a truncated cylinder.

In some embodiments, the sponge head is shaped so as to include a hemisphere.

In some embodiments, the sponge head is shaped so as to include at least a cone.

In some embodiments, a cross-section perpendicular to a central axis of the body surface of the sponge body is one of: triangular, square, hexagonal, octagonal, round.

BRIEF DESCRIPTION OF THE DRAWINGS

The invention will be more fully understood from the following detailed description, in conjunction with the following figures, wherein.

DETAILED DESCRIPTION

Figure 1:
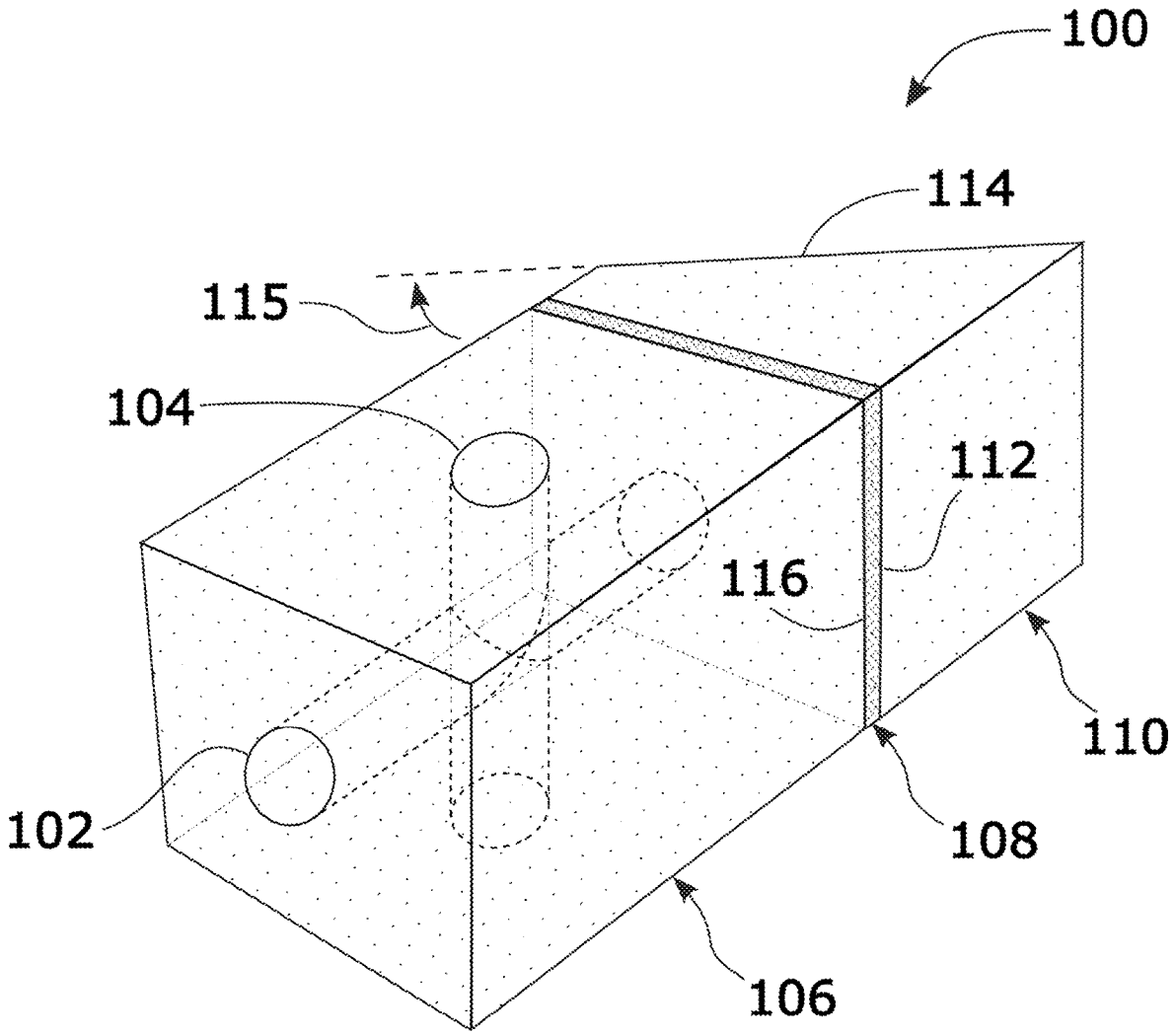
FIG. 1 is an isometric view of an embodiment of the handle-storable sponge mop with scrubber, showing perpendicular working and storage channels in a sponge body with square cross-section, each channel for receiving a broom handle, also showing a square scrubber pad, and a square truncated prism sponge head.

With reference to FIG. 1, an isometric view is shown of an embodiment of the handle-storable sponge mop with scrubber 100, showing working channel 102 and storage channel 104 in perpendicular relationship. The channels 102 and 104 extend through a sponge body 106 having a square cross-section. Of course, the sponge body 106 could also have a round cross section, or a polygonal cross section, e.g., a polygonal cross section having 3, 4, 5, or more sides. The sponge body 106 could also have a cross section that is rectangular. Each channel 102 and 104 is sized and shaped so as to receive a broom handle. Also shown in FIG. 1 is a square scrubber pad 108, and a square truncated prism sponge head 110.

The square truncated prism sponge head 110 has a base surface 112 and a sponge head surface 114. The base surface 112 is shaped so as to match the shape of the leading surface 116 of the sponge body 106. The base surface 112 of the sponge head 110 is attached to the scrubber pad 108, using a suitable adhesive, for example. The sponge head surface 114 slants at an acute angle 115, such as 45 degrees, for example.

Figure 2:
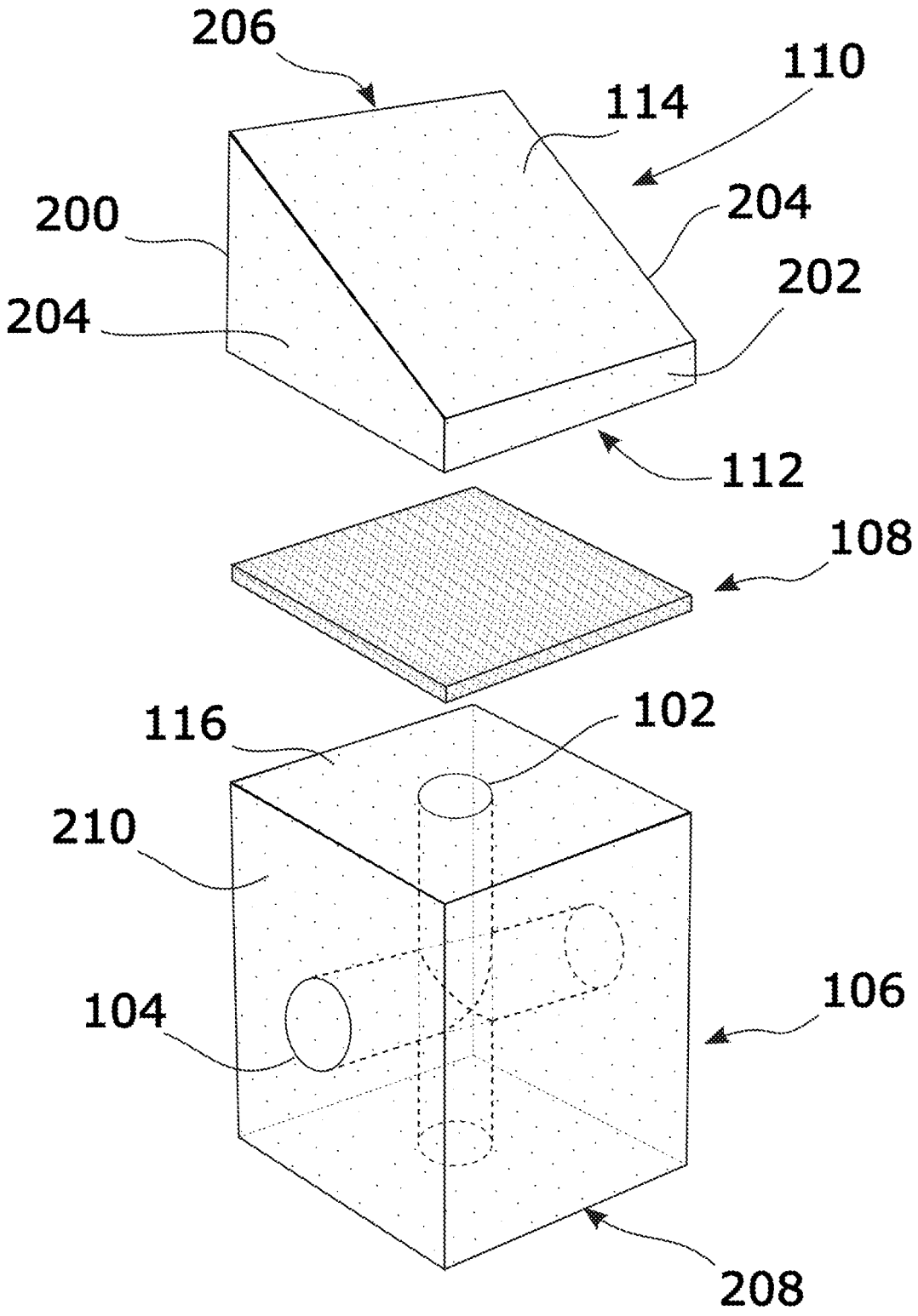
FIG. 2 is an exploded isometric view of the embodiment of FIG. 1, showing the perpendicular channels in the sponge body with square cross section, also showing the square scrubber pad, and the square truncated prism sponge head.

Referring to FIG. 2, an exploded isometric view of the embodiment 100 of FIG. 1 is shown. The sponge head 110 is shaped as a truncated prism. The truncated prism has a base surface 112, a sponge head surface 114, a longest rectangular side 200 (facing away), a shortest rectangular side 202, and a pair of right-trapezoidal sides 204. The sponge head surface 114 and the longest rectangular side 200 together forming a leading beveled cleaning edge 206.

FIG. 2 also shows the perpendicular channels 102 and 104 in the sponge body 106 with square cross section. The square scrubber pad 108 is shown between the sponge body 106 and the square truncated prism sponge head 110. Note that the square scrubber pad 108 is shaped and sized so as to match the shape and size of the cross-sectional shape of both the sponge body 106 and the square truncated prism sponge head 110.

FIG. 2 also shows that the sponge body 106 has a trailing surface 208 (underside), a leading surface 116, and a four-sided body surface 210 extending between the trailing surface 208 and the leading surface 116. The working channel 102 extends longitudinally through the sponge body 106. The working channel 102 has a first open end in the trailing surface 208, and a second open end in the leading surface 116. The storage channel 104 extends across through the sponge body 106, the storage channel 104 having two open ends in the body surface 210. The working channel 102 and the storage channel 104 each are configured to receive the handle end of a broom handle.

Figure 3A:
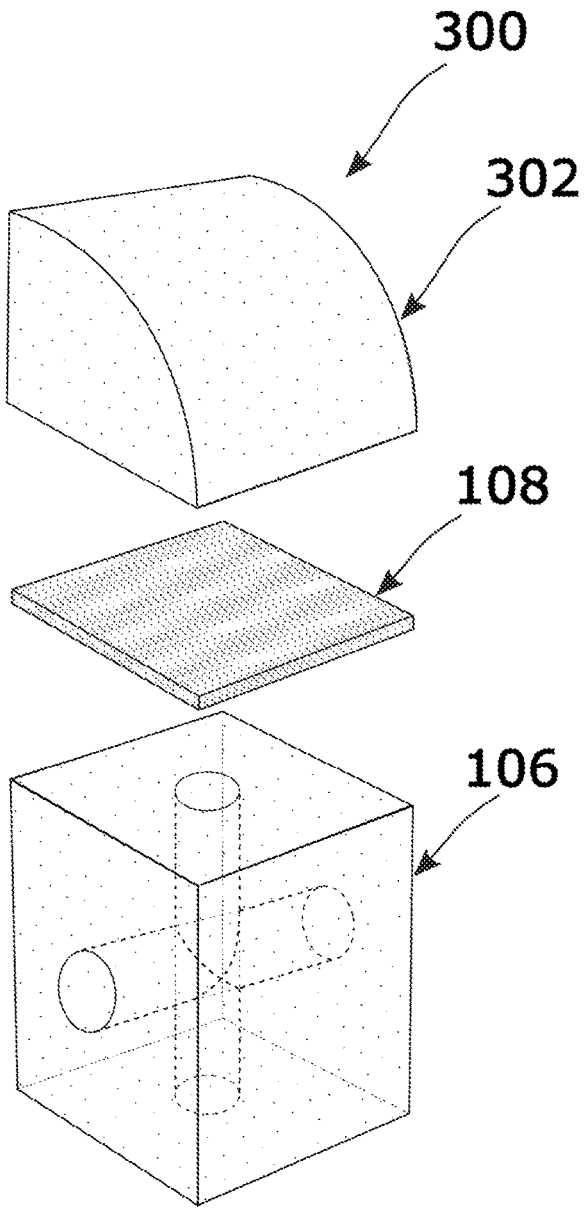
FIG. 3A is an exploded isometric view of another embodiment of the handle-storable sponge mop with scrubber, showing a quarter cylinder sponge head.

With reference to FIG. 3A, an exploded isometric view is presented of another embodiment 300 of the handle-storable sponge mop with scrubber, showing a handle-storable sponge mop with scrubber having a quarter cylinder sponge head 302. The quarter cylinder sponge head 302 is a quarter section of a cylindrical sponge. Also shown in FIG. 3A is a square scrubber pad 108, and a square sponge body 106, as shown in FIGS. 1 and 2. Note that the square scrubber pad 108 is shaped and sized so as to match the shape and size of the cross-sectional shape of both the sponge body 106 and the quarter cylinder sponge head 302.

Figure 3B:
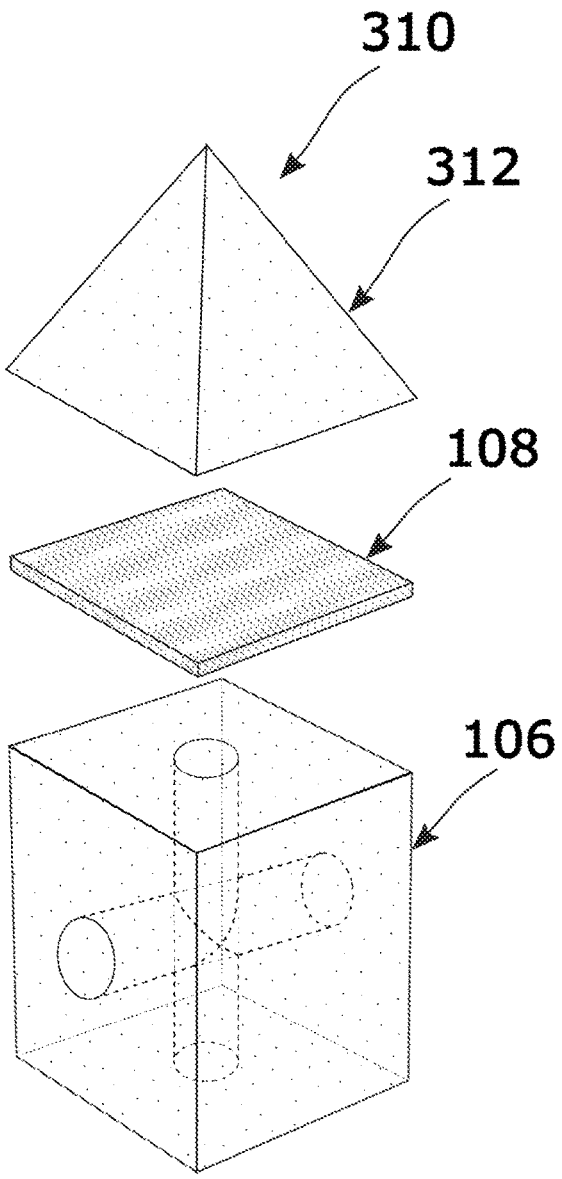
FIG. 3B is an exploded isometric view of another embodiment of the handle-storable sponge mop with scrubber, showing a square pyramid sponge head.

With reference to FIG. 3B, an exploded isometric view is presented of another embodiment 310 of the handle-storable sponge mop with scrubber, showing a handle-storable sponge mop with scrubber having a square pyramid sponge head 312. The square pyramid sponge head 312 is a square pyramid sponge with four triangular sides surrounding a square base. Also shown in FIG. 3B is a square scrubber pad 108, and a square sponge body 106, as shown in FIGS. 1 and 2. Note that the square scrubber pad 108 is shaped and sized so as to match the shape and size of the cross-sectional shape of both the sponge body 106 and the base of the square pyramid sponge head 312.

Figure 4A:
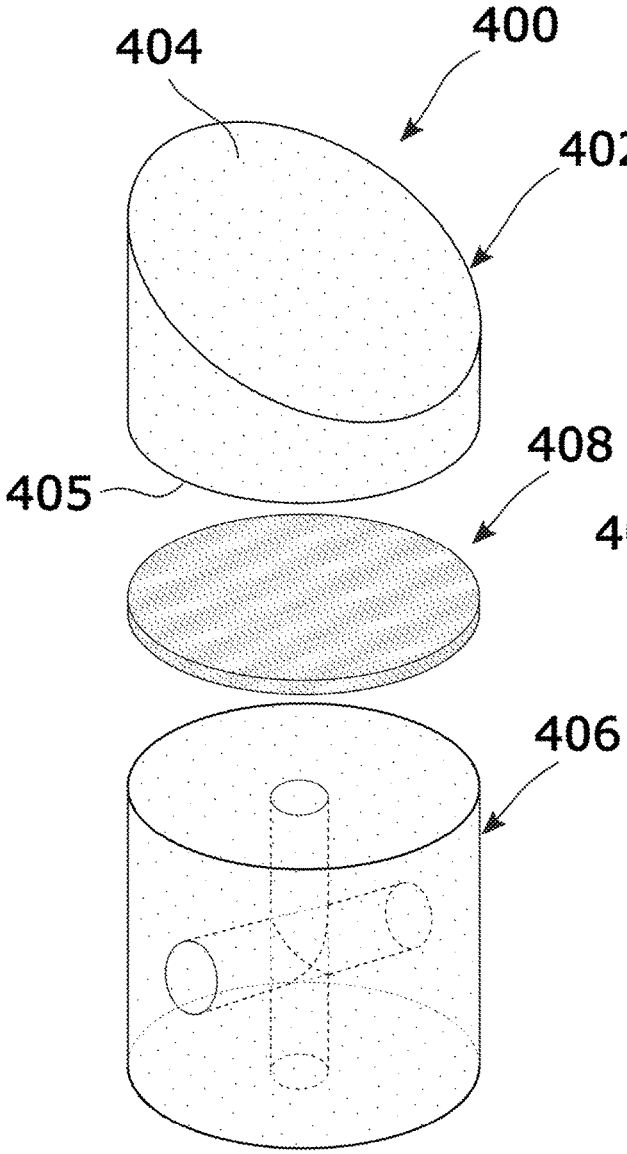
FIG. 4A is an exploded isometric view of another embodiment of the handle-storable sponge mop with scrubber, showing a cylinder sponge body, a round scrubber pad, and a truncated cylinder sponge head.

With reference to FIG. 4A, an exploded isometric view is presented of another embodiment 400 of the handle-storable sponge mop with scrubber, showing a handle-storable sponge mop with scrubber having a truncated cylinder sponge head 402. The truncated cylinder sponge head 402 is truncated cylinder with a flat oval sponge head surface 404 and a round flat base 405. Also shown in FIG. 4A is a round scrubber pad 408, and a cylindrical sponge body 406. Note that the round scrubber pad 408 is shaped and sized so as to match the shape and size of the cross-sectional shape of both the cylindrical sponge body 406 and the base of the truncated cylinder sponge head 402.

Figure 4B:
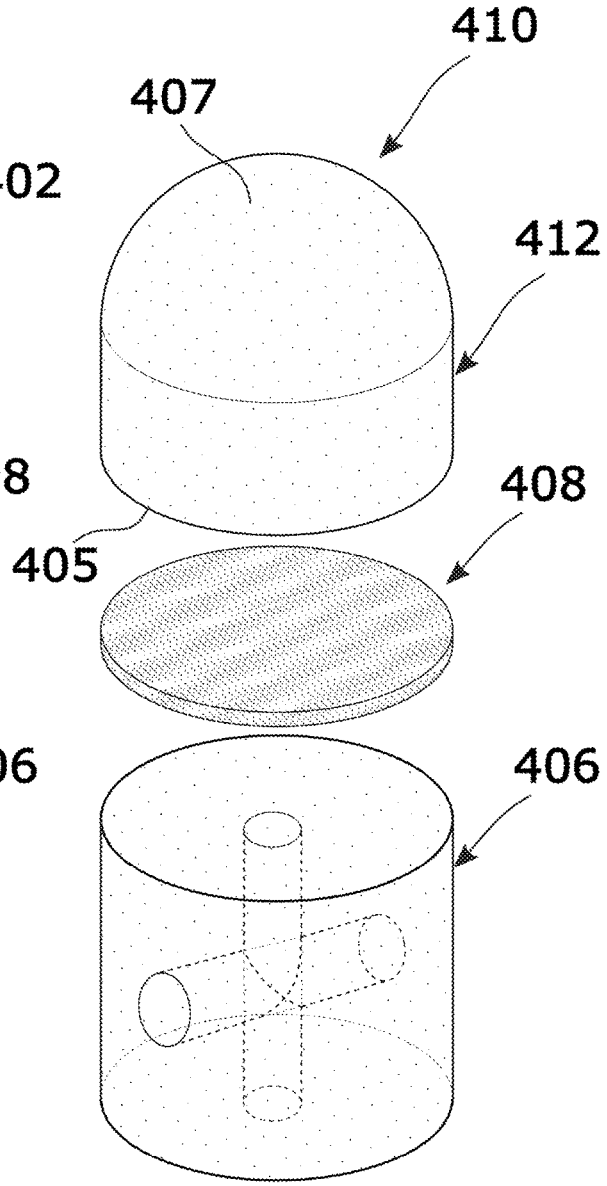
FIG. 4B is an exploded isometric view of another embodiment of the handle-storable sponge mop with scrubber, showing a cylinder sponge body, a round scrubber pad, and a cylindrical sponge head terminating in a hemisphere.

With reference to FIG. 4B, an exploded isometric view is presented of another embodiment 410 of the handle-storable sponge mop with scrubber, showing a handle-storable sponge mop having a cylindrical sponge head terminating in a hemisphere 412. The cylindrical sponge head terminating in a hemisphere 412 includes a truncated cylinder 412 having a hemispherical sponge head surface 407, and a round flat base 405. Also shown in FIG. 4B is a round scrubber pad 408, and a cylindrical sponge body 406. Note that the round scrubber pad 408 is shaped and sized so as to match the shape and size of the cross-sectional shape of both the cylindrical sponge body 406, and the base of the cylindrical sponge head terminating in a hemisphere 412.

Figure 4C:
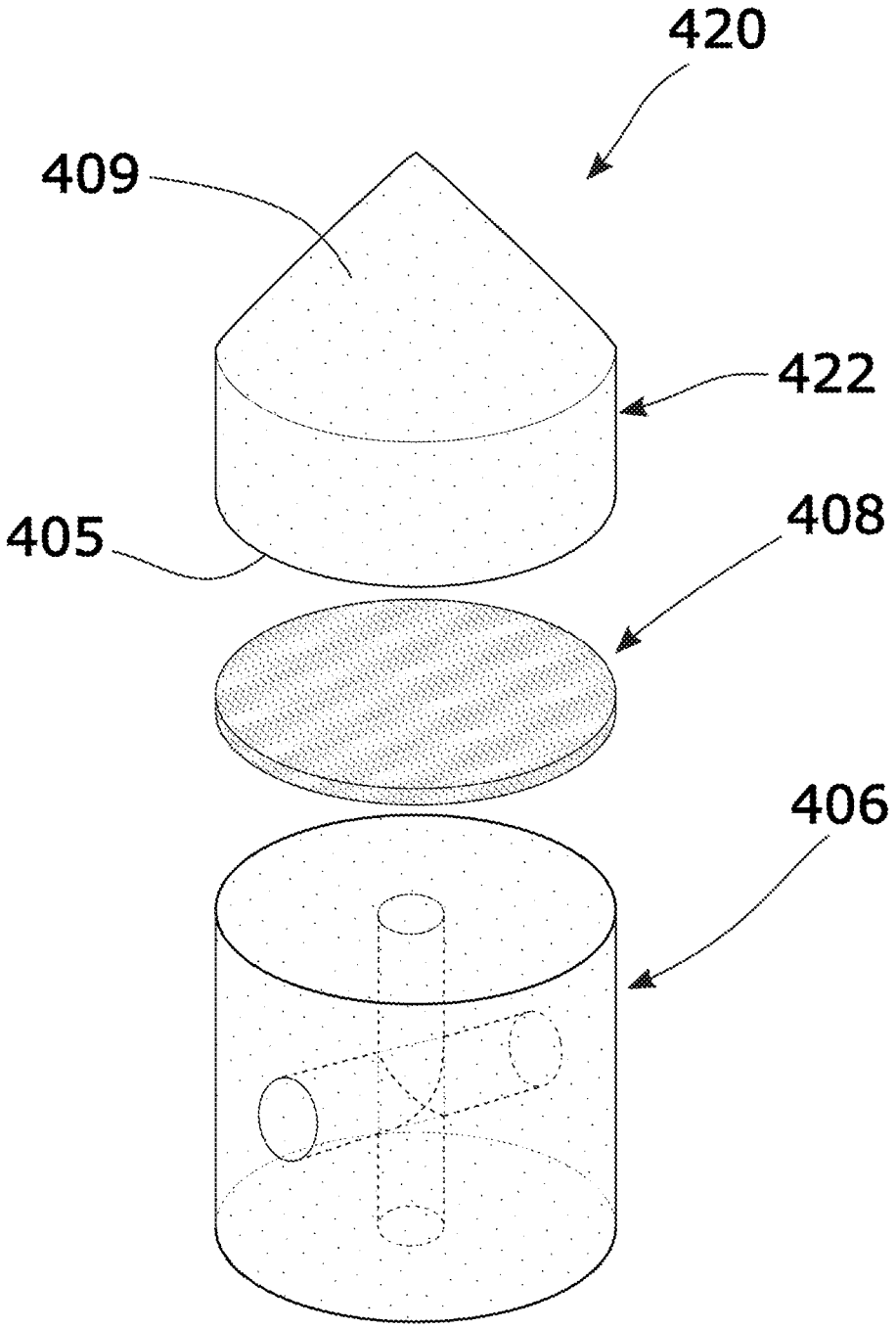
FIG. 4C is an exploded isometric view of another embodiment of the handle-storable sponge mop with scrubber, showing a cylinder sponge body, a round scrubber pad, and a cylindrical sponge head terminating in a cone.

With reference to FIG. 4C, an exploded isometric view is presented of another embodiment 420 of the handle-storable sponge mop with scrubber, showing a handle-storable sponge mop having a cylindrical sponge head terminating in a cone 422. The cylindrical sponge head terminating in a cone 422 includes a truncated cylinder 422 having a conical sponge head surface 409, and a round flat base 405. Also shown in FIG. 4C is a round scrubber pad 408, and a cylindrical sponge body 406. Note that the round scrubber pad 408 is shaped and sized so as to match the shape and size of the cross-sectional shape of both the cylindrical sponge body 406, and the base of the cylindrical sponge head terminating in a cone 422.

Figure 5:
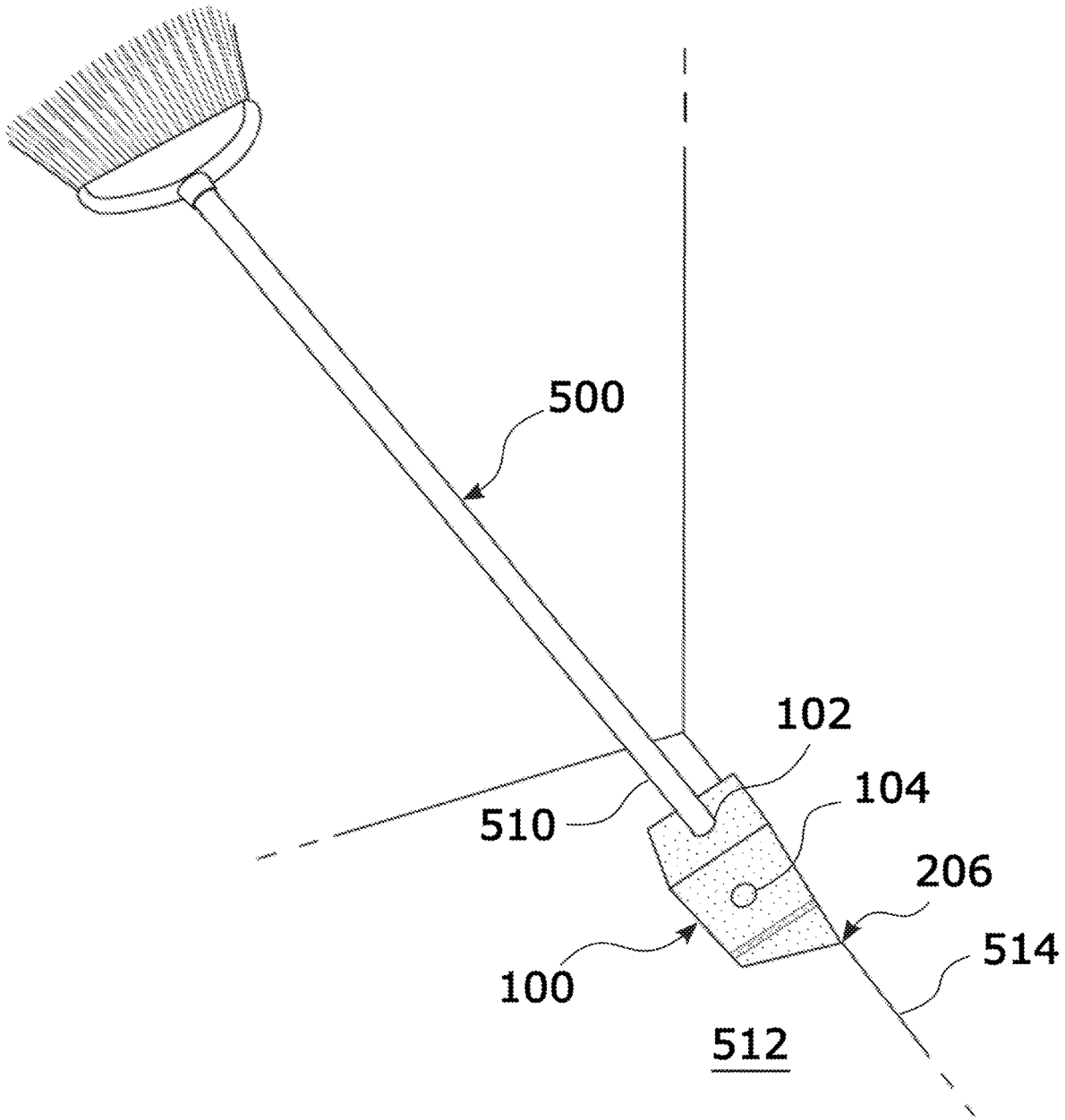
FIG. 5 is a perspective view of a handle end of a broom handle inserted into the working channel of the handle-storable sponge mop with scrubber of FIG. 1, showing the sponge mop in position for cleaning an edge of a floor using the beveled cleaning edge of the sponge mop.

Referring to FIG. 5, is a perspective view is presented of a handle end 510 of a broom handle 500 inserted into the working channel 102 of the handle-storable sponge mop with scrubber 100 of FIG. 1, showing the sponge mop 100 in position for cleaning an edge 514 of a floor 512 using the beveled cleaning edge 206 of the sponge mop 100. Also shown is the unused storage channel 104 of the handle-storable sponge mop with scrubber 100.

Figure 6A:
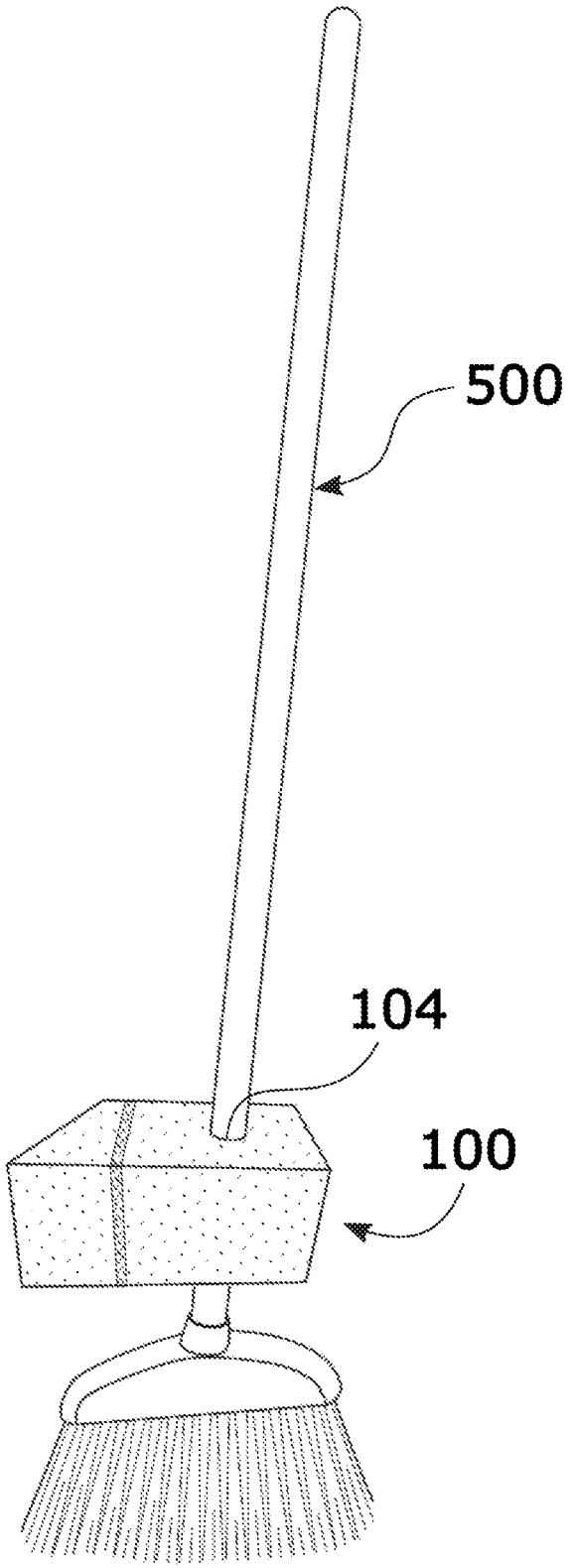
FIG. 6A is a perspective view of the handle-storable sponge mop with scrubber of FIG. 1, showing how the handle-storable sponge mop with scrubber can be stored on a broom handle using the storage channel of the sponge mop.

With reference to FIG. 6A, a perspective view is presented of the handle-storable sponge mop with scrubber 100 of FIG. 5, showing how the handle-storable sponge mop with scrubber 100 can be stored on the broom handle 500 using the storage channel 104 of the sponge mop 100.

Figure 6B:
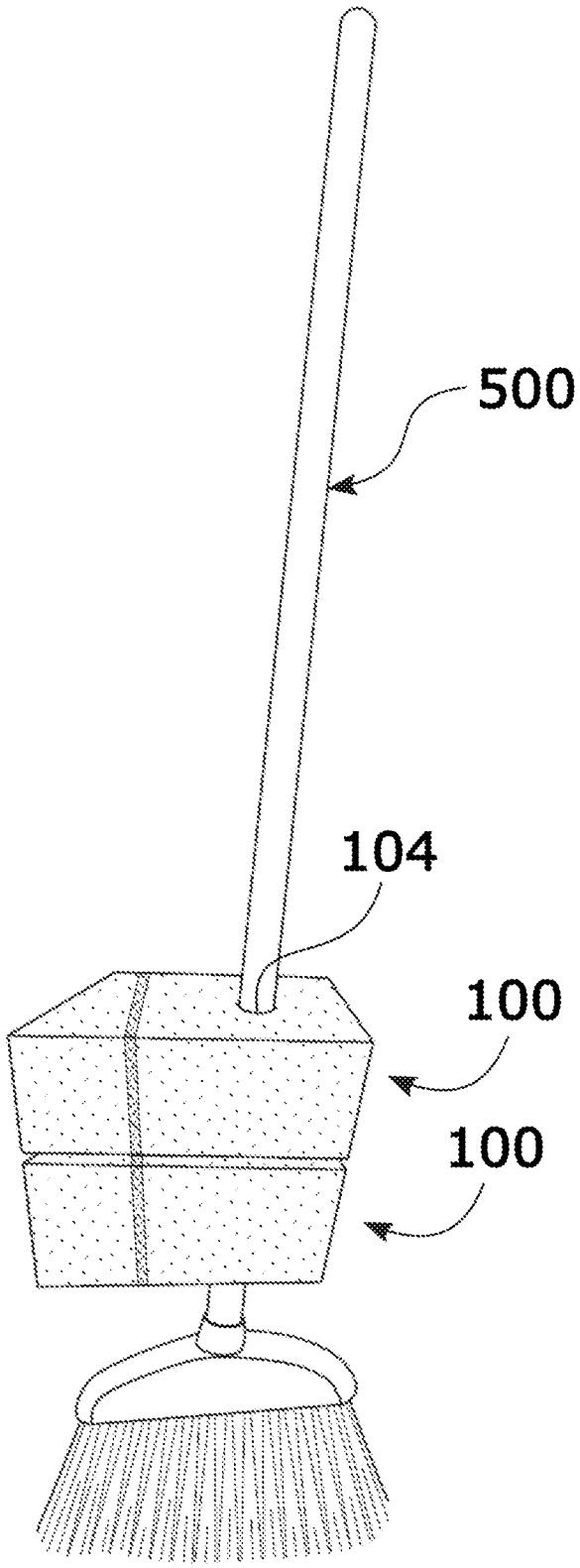
FIG. 6B is a perspective view of two handle-storable sponge mops with scrubber of FIG. 1, showing how two handle-storable sponge mops with scrubber can be stored on a single broom handle using the storage channel of each sponge mop.

With reference to FIG. 6B, a perspective view is presented of two handle-storable sponge mops with scrubber 100 of FIG. 5, showing how the two handle-storable sponge mops with scrubber 100 can be stored on the broom handle 500 using the storage channels 104 of each respective sponge mop 100. Of course, more than two sponge mops 100 can be stored on the broom handle 500.

Other modifications and implementations will occur to those skilled in the art without departing from the spirit and the scope of the invention as claimed. Accordingly, the above description is not intended to limit the invention, except as indicated in the following claims.

What is claimed is:

1. A handle-storable sponge mop with scrubber for use at a handle end of a broom handle, sponge mop comprising:

a sponge body having:

a trailing surface, a leading surface, and a body surface extending between the trailing surface and the leading surface, a working channel extending longitudinally through the sponge body, the working channel having a first open end in the trailing surface, and a second open end in the leading surface, and a storage channel extending across through the sponge body, the storage channel having two open ends in the body surface, the working channel and the storage channel each configured to receive the handle end of a broom handle;

a scrubber pad shaped so as to match the leading surface of the sponge body, the scrubber pad being attached to the leading surface of the sponge body; and a sponge head having a base surface and a sponge head surface, the base surface shaped so as to match the shape of the leading surface of the sponge body, the base surface of the sponge head being attached to the scrubber pad.

2. The handle-storable sponge mop with scrubber of claim 1, wherein the sponge head is shaped as a truncated prism, the truncated prism having a base surface, a leading face, a longest rectangular side, a shortest rectangular side, and a pair of right-trapezoidal sides, the leading face and the longest rectangular side together forming a leading beveled cleaning edge.

3. The handle-storable sponge mop with scrubber of claim 2, wherein the storage channel extends between a pair of rectangular sides of the body surface of the sponge body.

4. The handle-storable sponge mop with scrubber of claim 2, wherein the working channel extends perpendicularly between the trailing surface and the leading surface of the sponge body.

5. The handle-storable sponge mop with scrubber of claim 2, wherein the truncated prism is one of: a triangular truncated prism, a square truncated prism, a rectangular truncated prism, a hexagonal truncated prism, an octagonal truncated prism.

6. The handle-storable sponge mop with scrubber of claim 2, wherein the truncated prism is a truncated right prism in which the longest rectangular side, the shortest rectangular side, and the pair of right-trapezoidal sides are perpendicular to the base surface.

7. The handle-storable sponge mop with scrubber of claim 1, wherein the base surface is one of: a triangle, a square, a rectangle, a hexagon, an octagon, a circle.

8. The handle-storable sponge mop with scrubber of claim 1, wherein the working channel extends perpendicularly into the trailing surface of the sponge body.

9. The handle-storable sponge mop with scrubber of claim 1, wherein the working channel and the storage channel are cylindrical channels.

10. The handle-storable sponge mop with scrubber of claim 1, wherein the working channel and the storage channel intersect.

11. The handle-storable sponge mop with scrubber of claim 1, wherein a central axis of the working channel and a central axis of the storage channel are in substantially perpendicular relationship.

12. The handle-storable sponge mop with scrubber of claim 1, wherein a central axis of the storage channel intersects with a central axis of the working channel.

13. The handle-storable sponge mop with scrubber of claim 1, wherein a central axis of the storage channel extends perpendicularly with respect to a central axis of the sponge body.

14. The handle-storable sponge mop with scrubber of claim 1, wherein the sponge mop body and the sponge mop head are made entirely of absorbent material.

15. The handle-storable sponge mop with scrubber of claim 14, wherein the absorbent material is selected from: polyurethane foam, foam rubber sponge material, microfiber textile, stranded cotton, stranded synthetic fiber, and stranded Rayon.

16. The handle-storable sponge mop with scrubber of claim 1, wherein the scrubber pad is made from heavy duty fiber material.

17. The handle-storable sponge mop with scrubber of claim 16, wherein the scrubber pad is configured to resist penetration by the handle end of a broom handle when the broom handle is forced against the scrubber pad during use.

18. The handle-storable sponge mop with scrubber of claim 1, wherein the sponge head is shaped so as to include a quarter cylinder.

19. The handle-storable sponge mop with scrubber of claim 1, wherein the sponge head is shaped so as to include a pyramid.

20. The handle-storable sponge mop with scrubber of claim 1, wherein the sponge head is shaped as a truncated cylinder.

21. The handle-storable sponge mop with scrubber of claim 1, wherein the sponge head is shaped so as to include a hemisphere.

22. The handle-storable sponge mop with scrubber of claim 1, wherein the sponge head is shaped so as to include a cone.

* * * * *